United States Patent [19]

Chang

[11] Patent Number: 4,748,918

[45] **Date of Patent: * Jun. 7, 1988**

[54] INCINERATOR FOR THE HIGH SPEED COMBUSTION OF WASTE PRODUCTS

[76] Inventor: Shien F. Chang, 80-50 Baxter Ave., #369, Elmhurst, N.Y. 11373

[ * ] Notice: The portion of the term of this patent subsequent to Dec. 30, 2003 has been disclaimed.

[21] Appl. No.: 909,450

[22] Filed: Sep. 19, 1986

Related U.S. Application Data

[63] Continuation-in-part of Ser. No. 792,967, Oct. 30, 1985, Pat. No. 4,632,042.

[51] Int. Cl.[4] ..... F23G 5/00; F23D 1/02

[52] U.S. Cl. ..... 110/255; 110/262; 110/264; 110/265

[58] Field of Search ..... 110/259, 255, 266, 265, 110/264, 243, 244

[56] References Cited

U.S. PATENT DOCUMENTS

| | | | |
|---|---|---|---|
| 2,800,093 | 7/1957 | Bung | 110/264 |
| 3,589,315 | 6/1971 | Hart | 110/264 |
| 3,906,874 | 9/1975 | Janonko et al. | 110/255 |
| 4,009,667 | 3/1977 | Tyer et al. | 110/255 |
| 4,026,223 | 5/1977 | Robbins | 110/259 |
| 4,096,808 | 6/1978 | Trickel | 110/264 |
| 4,132,180 | 1/1979 | Fredrick | 110/265 |
| 4,422,388 | 12/1983 | Raskin | 110/264 |
| 4,428,309 | 1/1984 | Chang | 110/262 |

*Primary Examiner*—Henry C. Yuen

*Attorney, Agent, or Firm*—Hedman, Gibson, Costigan & Hoare

[57] ABSTRACT

The present invention provides an incinerator capable of completely burning pulverized coal or oil and waste products. The main feature of this invention resides in that a heavy oil or a pulverized coal can be mixed with a primary air flow and injected into the burning furnace so as to introduce a rapidly revolving secondary air flow from tangential air flow inlets on an inner pipe to help combustion and thus completely burn waste products which are sent into the incinerator through a preheating chamber. Tangential air inlets and a radiating whirling sheets are provided on the inner pipe of the incinerator so as to enable a primary air flow and a secondary air flow in the incinerator to continuously revolve the waste products and thus lengthen the time duration of combustion.

5 Claims, 10 Drawing Sheets

A-A

A-A

INCINERATOR FOR THE HIGH SPEED COMBUSTION OF WASTE PRODUCTS

CROSS REFERENCE TO RELATED APPLICATION

This application is a continuation-in-part of Ser. No. 792,967, filed Oct. 30, 1985 now U.S. Pat. No. 4,632,042.

The present invention is concerned with an incinerator for the high speed combustion of waste products.

BACKGROUND OF THE INVENTION

The handling of waste products has been becoming one of the serious problems encountered by contemporary human beings because the waste products affect the ecology and have occupied more and more room which is precious to human beings. Many people are using incinerators to handle waste products. Theoretically speaking, sufficient oxygen and suitable dryness of the waste products are the two main factors for optimizing the combustion in the incinerators. Some conventional incinerators produce atmospheric pollution in the nature of bad odors because of the design. These defects provide insufficient oxygen and thus the combustion therein is not complete.

In the utilization of incinerators, heavy discarded articles such as discarded tires and/or cables containing steel wires or the like, or metal articles are blended with the usual discarded articles to be burned and sent into the incinerators. These heavy discarded articles can result in the clogging of the incinerator, unless the incinerator is stopped periodically to remove these articles.

OBJECTS AND SUMMARY OF THE INVENTION

Thus the present invention is aimed to overcome or substantially eliminate the above disadvantages.

The primary object of the present invention is to provide tangential air inlets on an inner pipe of the incinerator so that an air flow can rapidly revolve in the incinerator to help combustion and produce intense flame and high temperature. Thus the waste products sent into the incinerator can be substantially completely burned or melted and no residue which has not been completely burned can be produced. Thereby the problem of handling waste products can be solved.

Another object of the present invention is to utilize a tertiary air flow to sufficiently preheat the waste products before they are introduced into the incinerator. Therefore, the waste products can be dried and the temperature thereof can be raised so as to facilitate and optimize the combustion.

Still another object of the present invention is that a plurality of tangential air inlets and radiating whirling sheets are provided on the peripheral walls of the inner pipes of the burning furnace and the incinerator. These tangential air inlets and the radiating whirling sheet not only increase the speed of the revolving secondary air flow and a tertiary air flow, but also generate a hot air flow surrounding the waste products under combustion, driving the same to revolve continuously along the inside of the pipe of the incinerator, and making the same look like a burning fire ball. Thus the path passed by the burning waste product can be lengthened, the duration of the combustion can be lengthened, and the complete combustion can be achieved, (The said path passed by the burning waste products approximately equals the product of, the diameter of the incinerator, and the number of the revolutions. Therefore, the said revolving can lengthen the said path and, furthermore, facilitate the automatic discharge of the ash and residue after the combustion).

A further object of the present invention resides in that a conveyer having a net-shaped conveying face is provided on the incinerator with a plurality of partition plates on the conveyor. Waste products can be sufficiently preheated and prevented from being blown away by the air flow when they are being preheated.

Still a further object of the present invention is that an accessory equipment for separating the ash and the residue is provided on the incinerator for efficiently collecting the ash and residue, and eliminating the problems such as the plugging of the pipe, and atmospheric pollution.

One more object of the present invention is to provide an incinerator of simpler structure and a lower cost than those of the conventional ones.

A further object of the present invention is the provision of an ash conveyor in the incinerator. Partition plates are provided so that the air flows in the incinerator can be prevented from being hindered A housing is provided for the ash conveyor chamber so that one is protected from contact with the moving conveyor These and other objects, features and advantages of the invention will become more apparent from a consideration of the following description taken in connection with the accompanying drawings.

DESCRIPTION OF THE PREFERRED EMBODIMENTS

Figure 1:
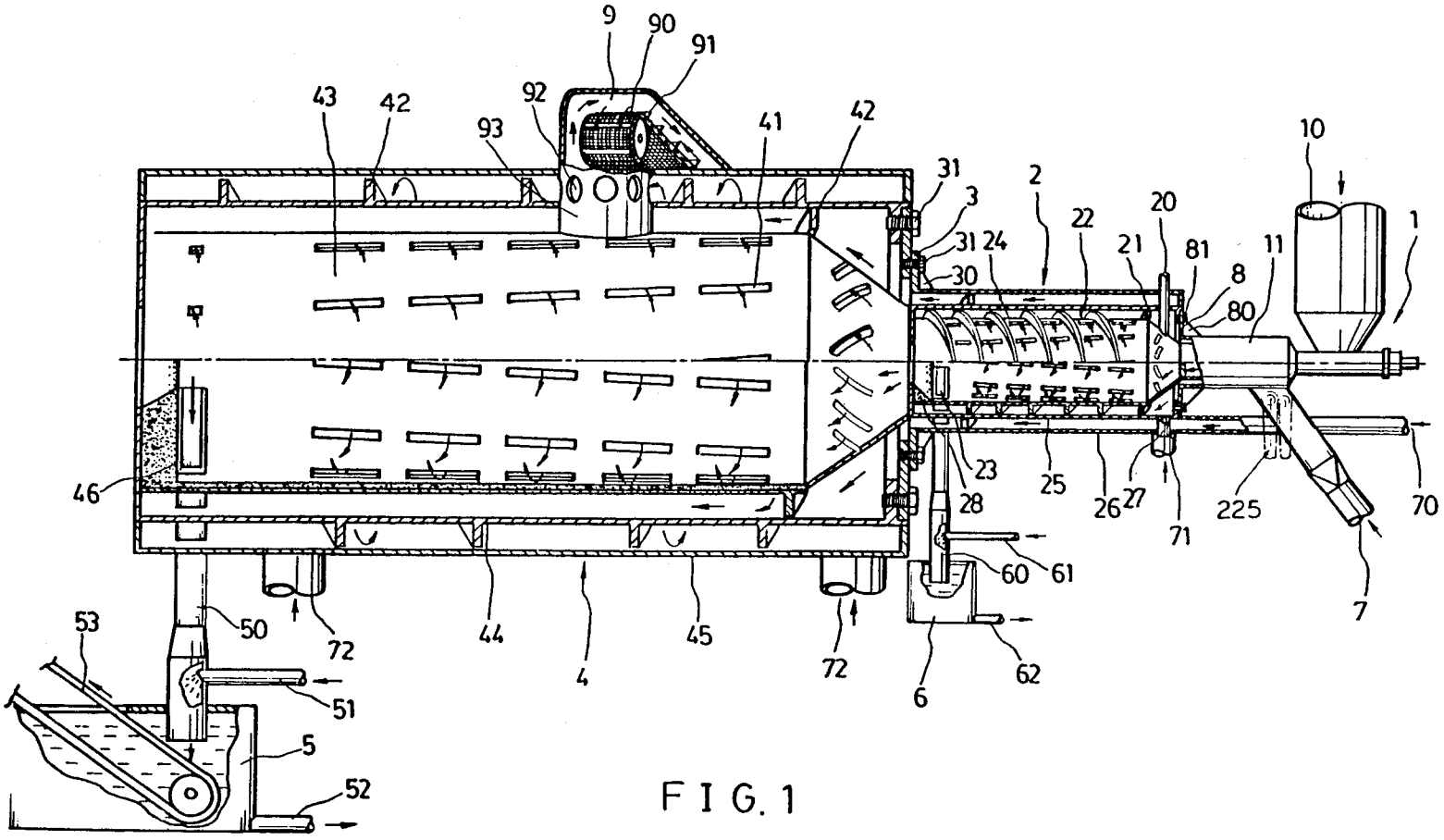
FIG. 1. is a partial cross-sectional view of an incinerator according to the present invention.

As seen from FIG. 1, the incinerator of the present invention comprises mainly a burner 1, a burning furnace 2, and an incinerator 4. The burner 1 can be of the type disclosed in my U.S. Pat. No. 4,428,309 issued on Jan. 31, 1984 and is employed to control the air flow and the fuel.

Figure 2:
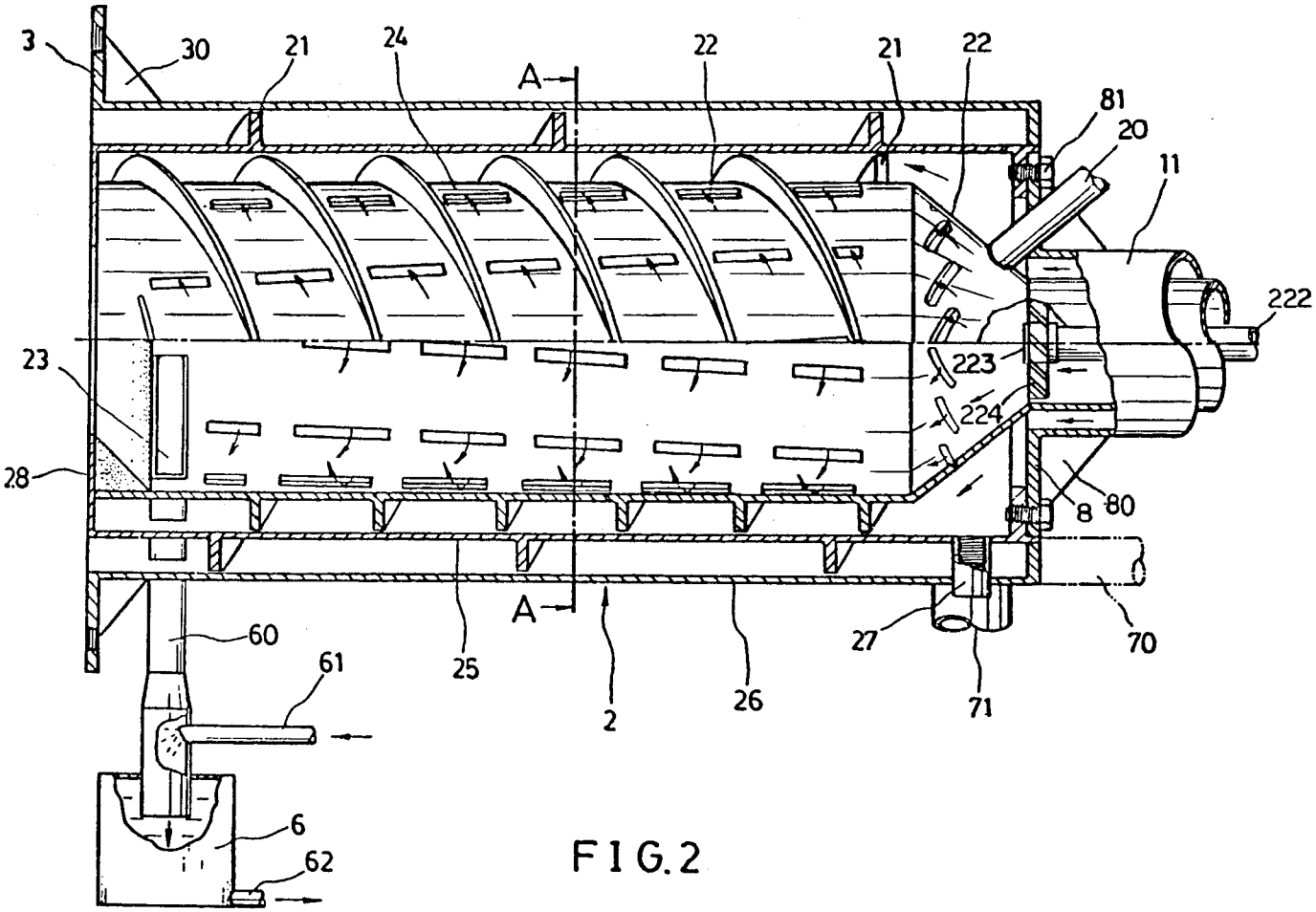
FIG. 2. is an enlarged partial cross-sectional view of an embodiment of a burning furnace utilized in the present invention.
Figure 3:
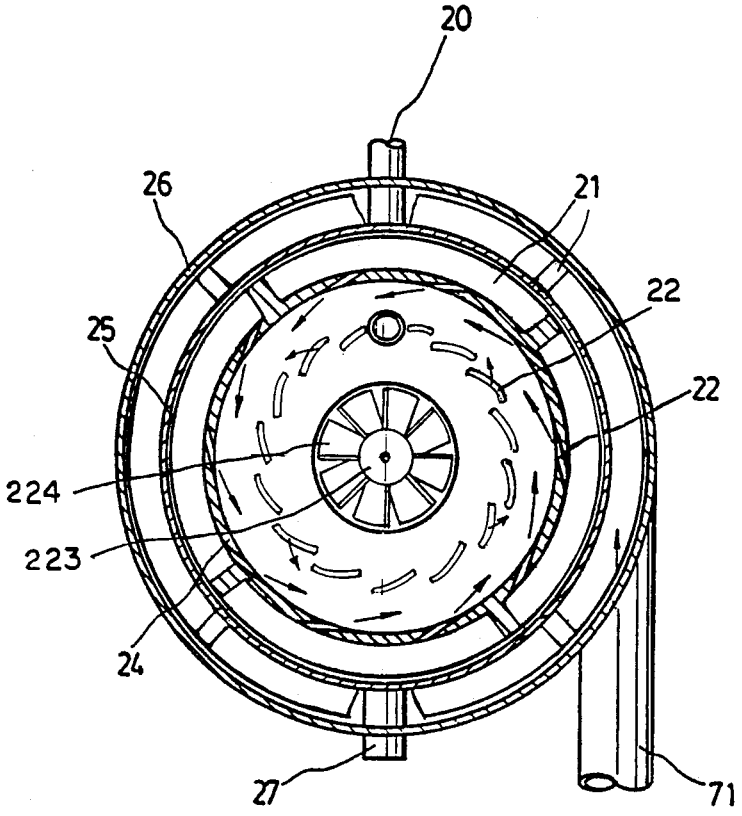
FIG. 3. is a cross-sectional view taken along line A—A of FIG. 2.

The burner 1 includes essentially a fuel tank 10, a mixer 11, and a controller for controlling the amount of the fuel and the air flow (not shown in the drawings). The fuel tank 10 is of funnel shape and is employed for the storing and cleaning of the fuel. As best seen in FIG. 2, the mixer 11 has an inner pipe, an intermediate pipe, and an outer pipe, and is provided with an oil sprayer 223 and fan-shape whirling or air directing sheets 224 on the central part thereof. A flange 8 is provided on the left end of the burner 1 for connecting with a burning furnace 2 or a boiler. A plurality of ribs 80 are provided on the flange 8 for reinforcement. This burner 1 is utilized for mixing uniformly the pulverized coal or heavy oil and a primary air flow, and injecting the same into a burning furnace 2 for combustion. This burner 1 can control the amount of the air flow and the fuel in response to a signal representing the temperature in the incinerator 4 by means of a conventional device not shown in the drawings.

Figure 4:
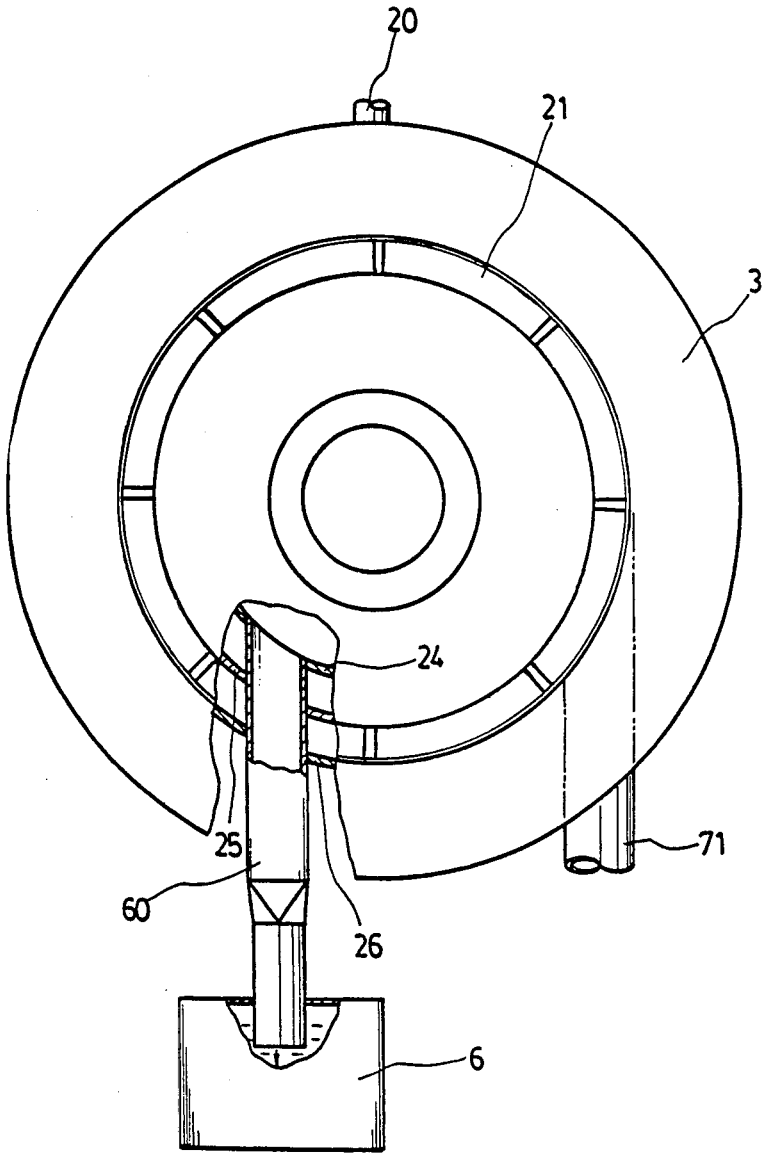
FIG. 4. is a left side view of the burning furnace shown in FIG. 2.
Figure 5:
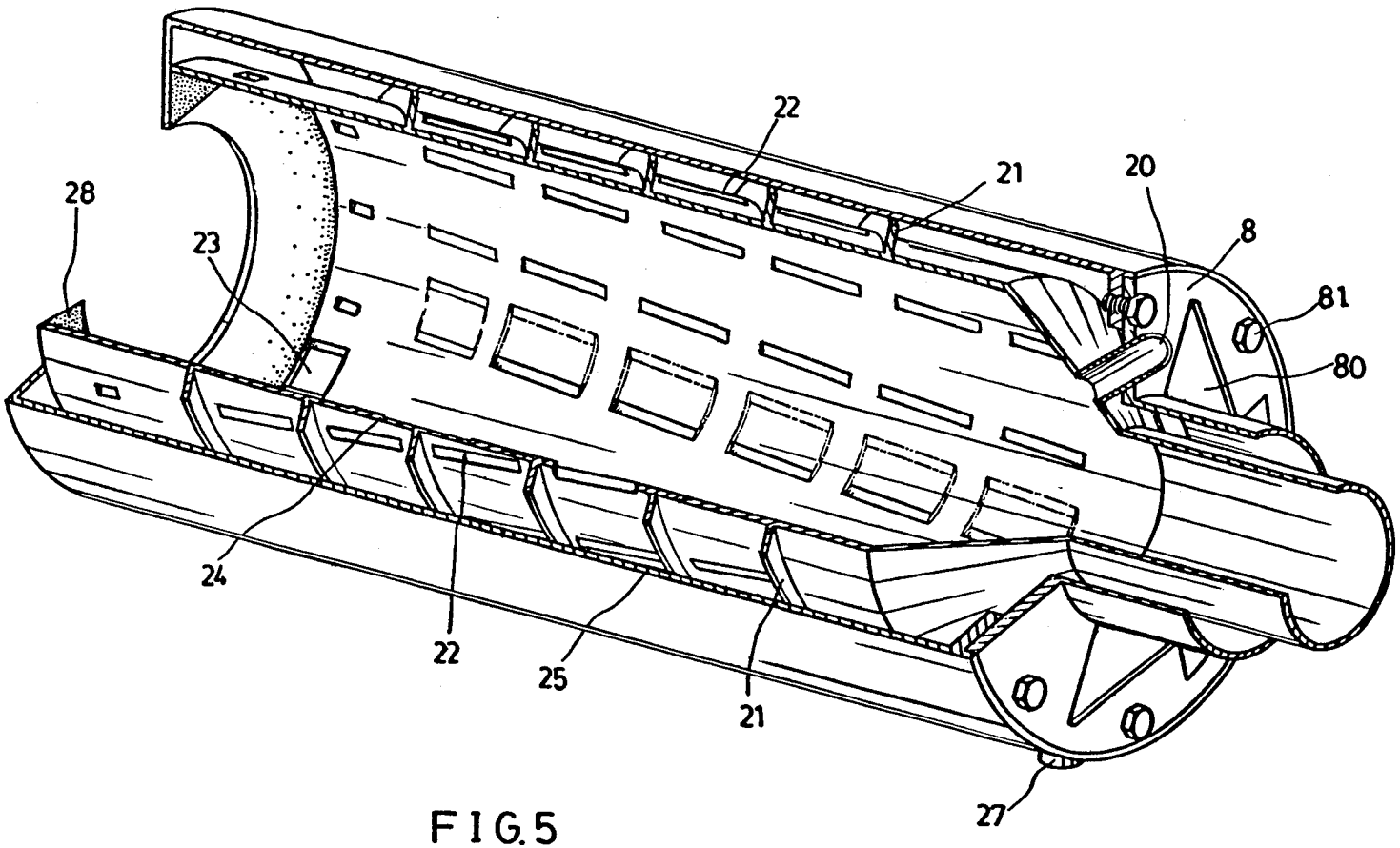
FIG. 5. is a parital cut-away view of the burning furnace shown in FIG. 2. showing an inner pipe. and intermediate pipe and relevant parts thereof.

As seen from FIGS. 2 and 5, the burning furnace 2 is comprised mainly of an inner pipe 24, an intermediate pipe 25, and an outer pipe 26 which are of transverse cylindrical shape. A neck portion of the inner pipe 24 is of truncated conical shape. The right end of the inner pipe 24 is connected with the flange 8 of the mixer 11 and is secured thereto with fastening screws 81. The left end of the inner pipe 24 is provided with the flange 3 for connecting with the incinerator 4. A plurality of ribs 30 are provided on the flange 3 for reinforcement. The inner pipe 24 is provided with several rows of tangental air flow inlets 22 which are inclined and arranged in alignment with each other. The inner pipe 24 is also provided with a radiating whirling or air directing sheet 21 to facilitate the rapid entering of the air from the inlets into the incinerator 4 for helping combustion. A spark plug 20 which is connected to an electrical means not shown in the drawing is provided on the top edge of the neck portion on the right end of the inner pipe 24. Refractory material 28 is arranged near the outlet on the left end of the inner pipe 24. An ash outlet 23 is provided on the buttom of the left end of the inner pipe 24. An ash discharge tube 60 is connected under the ash outlet 23 so that the ash resulted from the combustion can be discharged therefrom. As seen from FIG. 4, and 5, a water sprayer 61 is provided on the ash discharge tube 60 from the water sprayer 61 and flows out from a waste water discharge tube 62 on the bottom of the sedimentation water tank 6 for being circulated and utilized again. The bottom edge of the intermediate pipe 25 is provided with a preparatory heavy oil discharge tube 27 so that the heavy oil which has not been burned can be discharged therefrom. A radiating whirling or air directing sheet 21 is also provided around the intermediate pipe 25. As best seen in FIG. 2, two tertiary air flow inlets 70 and 72 are provided on the right end of the outer pipe 26 facing rightward and downward respectively as shown in the drawing. Air enters into the space between the outer pipe 26 and the intermediate pipe 25 in tangential direction from the tertiary air flow inlet 71 and then flows into the space inside of the inner pipe 24 through the tangential air flow inlets 22 under the influence of the radiating whirling or air directing sheets 21 so as to drive the waste products under combustion to rapidly revolve and advance.

The appearance and the structure of the incinerator 4 is similar to that of the burning furnace 2. As best seen in FIG. 1, an inner pipe 43, an intermediate pipe 44, and on outer pipe 45 are provided on the incinerator 4 which is secured to the burning furnace 2 with fastening screw 31. The inner pipe 43 is provided on its wall with several rows of tangential air inlets 41 which are inclined and arranged in alignment with each other. A waste products input duct 93 is mounted on the top of the central part of the inner pipe 43. The waste products input duct 93 penetrates through the intermediate pipe 44 and the outer pipe 45, and extends into a preheating chamber 9. A plurality of hot air bores 92 are provided on the section of the waste products input duct 93 between the intermediate pipe 44 and the outer pipe 45 so as to introduce a tertiary air flow of the incinerator 4 into the preheating chamber 9. The bottom of the left end of the inner pipe 43 is provided with an ash outlet part 46 which is connected with an ash discharge tube 50. The ash discharge tube 50 is provided with a water sprayer 51 on its wall, and a sedimentation water tank 5 on its lower end. A residue conveyer 53 is provided in the sedimentation water tank 5 which has a waste water discharge tube 52 mounted on its bottom for draining the waste water. A radiating whirling or air directing sheet 42 which is generally of the shape of helix is provided around the outer wall of the inner pipe 43. Two tertiary air flow inlets 72 are provided on the bottom of the outer pipe 45, one on the left side, the other on the right side, the tertiary air flow of the incinerator 4 flows into the space between the out pipe 45 and the intermediate pipe 44 along a tangential direction.

In operation, please refer to FIG. 1, the primary, the secondary, and the tertiary air flows can be blown rapidly into the burning furnace 2 by turning on a single blower providing simultaneously the three air flows or turning on three blowers each of which provides one of the three air flows respectively. The blowers are not shown in the drawings, the primary and the secondary air flows of the burning furnace 2 are introduced into the mixer 11 from the inlet 7. The primary air flow is mixed uniformly with the pulverized coal or heavy oil in the inner pipe of the mixer 11, injected into the inner pipe 24 of the burning furnace 2 and is ignited by the spark plug 20 when it is passing through the neck portion of the inner pipe 24. The secondary air flow is simultaneously introduced rapidly through the outer pipe of the mixer 11 into the space between the intermediate pipe 25 and the inner pipe 24 of the burning furnace 2. Because of the radiating whirling or air directing sheet 21 provided around the outer wall of the inner pipe 24, the secondary air flow, after entering the space between the inner pipe 24 and the intermediate pipe 25, will flow along tangential air flow inlets 22 and radiating whirling or air directing sheet 21, undergo heat exchange, and form a revolving high speed and high temperature air flow. This rapid hot air flow is introduced from the tangential air inlets 22 into the inner pipe 24 to help combustion so that the flame is injected into the incinerator 4 for providing the heat for combustion. The temperature at the left end outlet on the inner pipe 24 of the incinerator 4 is the highest in the incinerator 4, therefore, some refractory material 28 is arranged near the said outlet. The ash resulted from the combustion in the inner pipe 24 can automatically be separated because of the centrifugal force therein, discharged through the ash discharge tube 60, cooled with the water injected from the water sprayer 61, and sedimented in the sedimentation water tank 6. Besides, the tertiary air flow of the burning furnace 2 can be directed into the space between the intermediate pipe 25 and the outer pipe 26 of the burning furnace 2 through the inlet 70 or 71 to undergo heat exchange. Therefore, hot air flow can be introduced into the incinerator 4 to facilitate the combustion. Because of the arrangement of the radiating whirling or air directing sheet 21 on the outer wall of the intermediate pipe 25, the tertiary air flow can rapidly revolve in the space between the intermediate pipe 25 and the outer pipe 26 and simultaneously absorb the radiant heat from the inner pipe 24 so that the temperature can be raised. After the flame and the air flow have entered the incinerator 4, the primary air flow and the secondary air flow of the burning furnace 2 enter the inner pipe 43 of the incinerator 4 and form an intense fire ball to intensify the flame and drive the waste products which are disposed in the inner pipe 43 and surrounded by the air to revolve and be burned. The tertiary air flow of the burning furnace 2 enters the space between the inner pipe 43 and the intermediate pipe 44, revolvingly advances along the radiating whirling or air directing sheets on the outer wall of the inner pipe 43, and forms the secondary air flow of the incinerator 4. This secondary air flow produces a revolving wind which is introduced through the tangential air flow inlets 41 into the space inside of the inner pipe 43 to help combustion and to drive the waste products to revolvingly advance inside of the inner pipe 43. The tertiary air flow of the incinerator 4 flows from the tertiary air flow inlet 72 on the bottom of the outer pipe 45 into the space between the intermediate pipe 44 and the outer pipe 45 along a tangential direction. A radiating whirling sheet is also provided on the outer wall of the intermediate pipe 44 of the incinerator 4. Therefore, the tertiary air flow blown into the outer pipe 45 in tangential direction will revolvingly advance along the outer wall of the intermediate pipe 44 and simultaneously absorb the radiant heat of the inner pipe 43 by undergoing heat exchange and becomes hotter. This tertiary air flow of high temperature is introduced into the preheating chamber 9 through the hot air bores 92 on a waste products input duct 93 to sufficiently preheat the waste products on the conveyer 90 so that the waste products can be dehydrated introduced into the inner pipe 43, and efficiently burned. Furthermore, partition plates 91 are provided on the waste products conveyer 90, thus the waste products being preheated would not fall off the conveyer 90. The waste products in the inner pipe 43 are continuously burned and revolvingly advance along the inner wall of the inner pipe 43. The waste products are burned to ash which has been substantially completely burned because the waste products have passed through a long path in the incinerator 4 and the combustion duration is long. The ash is automatically separated and discharged at the ash discharged outlet 46, collected by ash discharge tube 50, cooled by the water injected from the water spayer 51, sedimented at the sedimentation water tank 5, and moved away by a residue conveyer 53.

The outlets on the left ends of the burning furnace 2 and the incinerator 4 are susceptible to high temperature, therefore, the portions near these outlets can be formed of refractory material to endure high temperature. Furthermore, the inner pipe 43 of the incinerator 4 can be completely made of refractory material.

Figure 6:
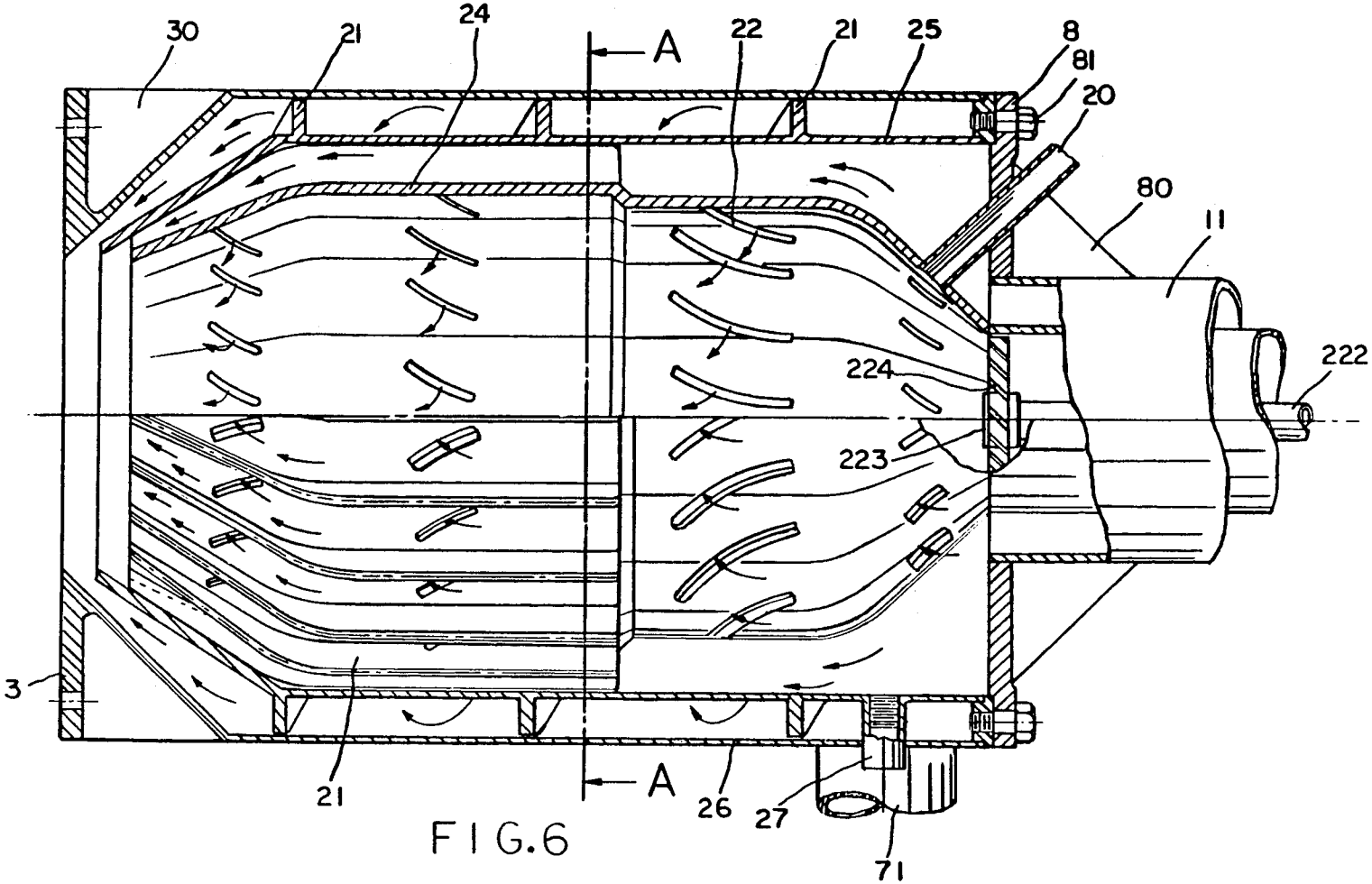
FIG. 6. is an enlarged partial cross-sectional view of another embodiment of the burning furnace utilized in the present invention.
Figure 7:
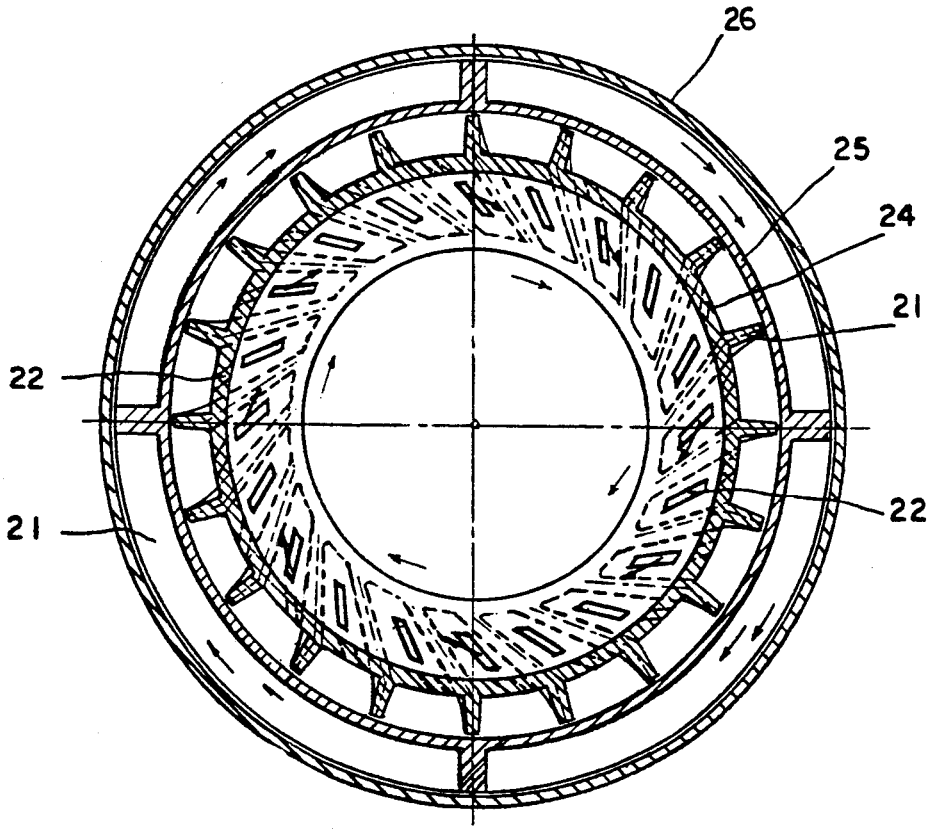
FIG. 7. is a cross-sectional view taken along line A—A of FIG. 6.
Figure 8:
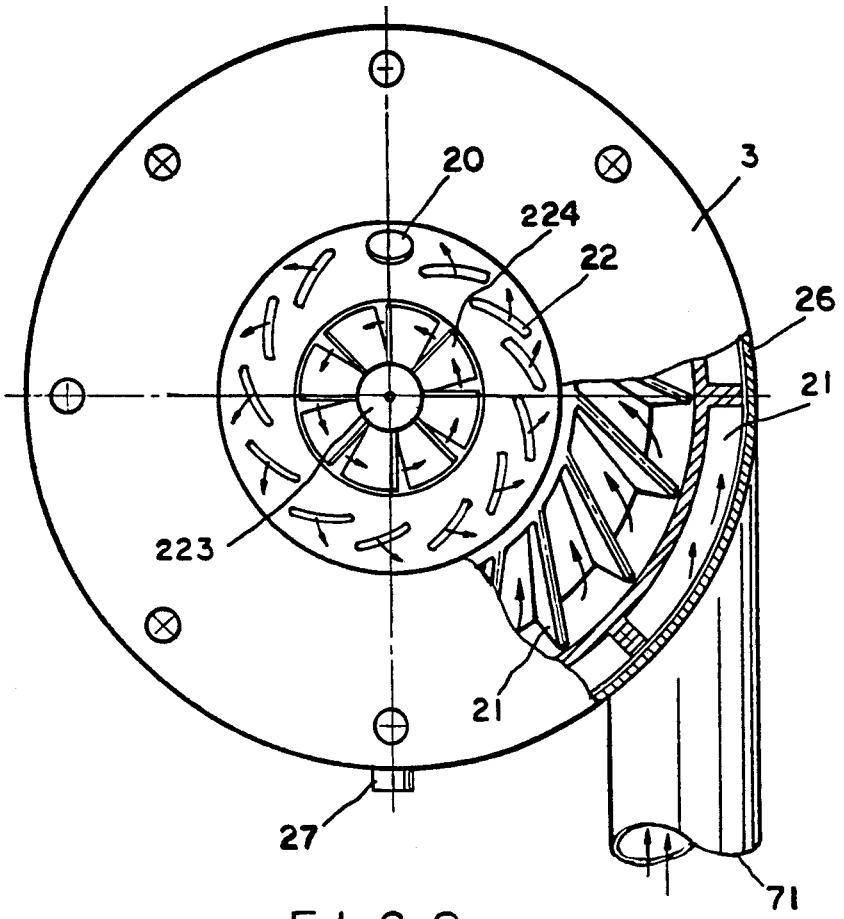
FIG. 8. is a left side view of the burning furnace shown in FIG. 6.

A second embodiment of the burning furnace 2 in the present invention is shown in FIGS. 6, 7 and 8. As seen from FIG. 6, two neck portions are provided on the left side and the right side of the inner pipe 24 of the burning furnace 2 respectively and are of truncated conical shape. Futhermore, several rows of tangential air flow inlets 22' are arrranged in inclined lines or straight lines. A secondary air flow is rapidly introduced into the inner pipe 24 from the tangential air flow inlets 22' for helping combustion. A plurality of fan-shaped whirling or air directing sheets 224 are provided on the connection portion between the right end of the inner pipe 24 and the left end of the mixer 11. An oil nozzle 223 is provided on the central part of the connection portion and is communicated with the mixer via an oil tube. A radiating whirling or air directing sheet 21' is arranged in a transver shape or a helical shape and is provided around the outer wall of the inner pipe 24 of the burning furnace. The radiating whirling or air directing sheet 21' is in the shape of a bent helix at the left neck portion of the inner pipe 2 from which a secondary air flow can be injected into the incinerator 4, the radiating whirling sheet 21 is employed to optimize radiation and to make the flame to be revolvingly injected into the incinerator 4.

A radiating whirling or air directing sheet 21' is also provided around the outer wall of the intermediate pipe 25 of the burning furnace 2 so that a tertiary air flow entering a tertiary air flow inlet 71 on the outer pipe 26 can rapidly revolvingly advance to radiate heat and be injected into the incinerator 4 to help combustion. The fuel and the air flow in this embodiment can also be automatically controlled and the primary air flow, the secondary air flow and a tertiary air flow can utilized to rapidly radiate heat and help combustion in the burning furnace 2 so as to achieve a complete combustion and inject an intense flame into the incinerator 4.

The burning furnace 2 of the first embodiment or the second embodiment can be comprised of an inner pipe, and an intermediate pipe instead of three pipes as illustrated.

In the operation of the incinerator an intense flame is utilized in the present invention to completely burn the waste products which can be advanced in a revolving direction in the incinerator so that the combustion effect can be optimized.

Figure 9:
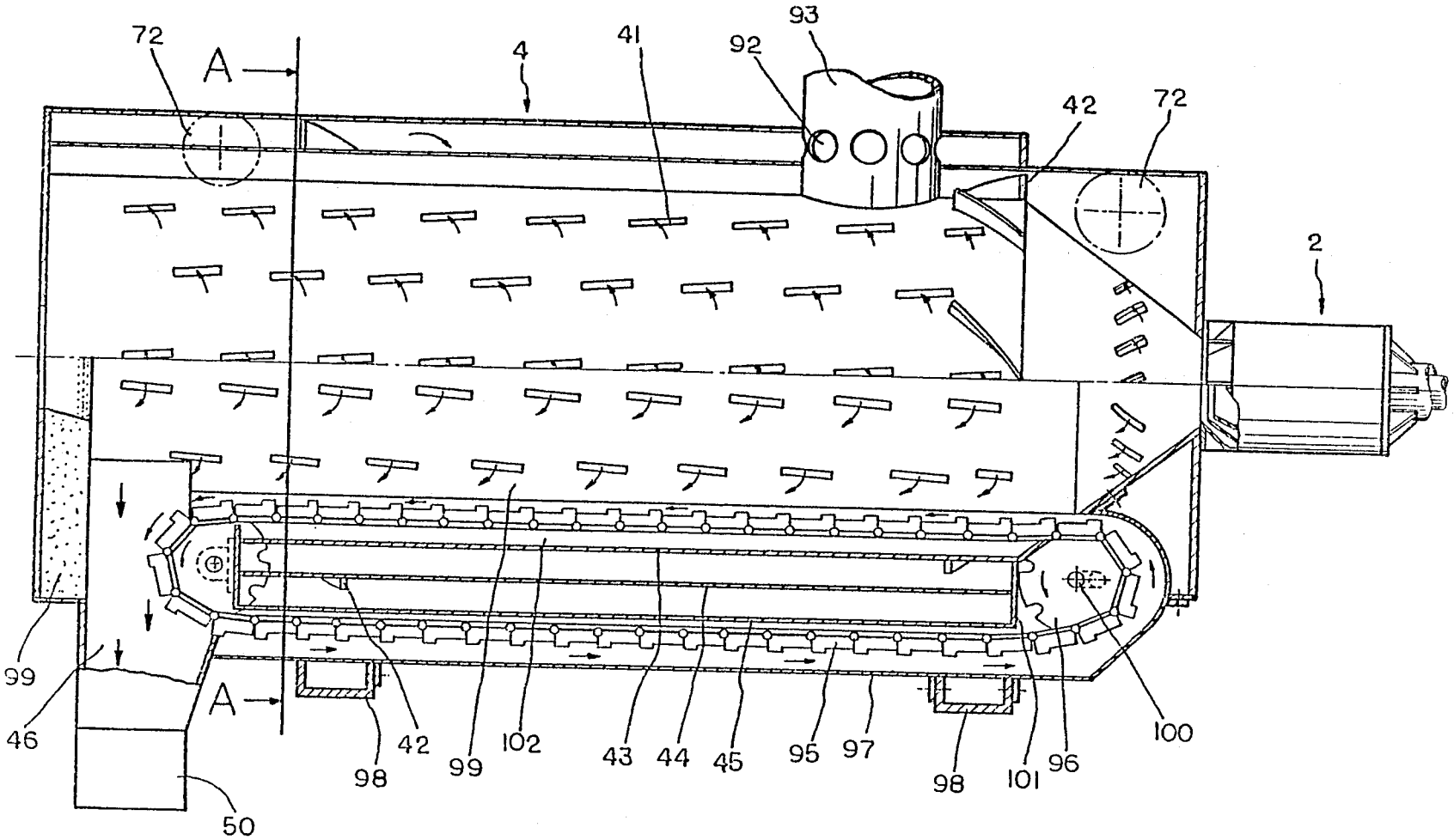
FIG. 9. is a partial cross-section view of an incinerator according to the present invention.
Figure 10:
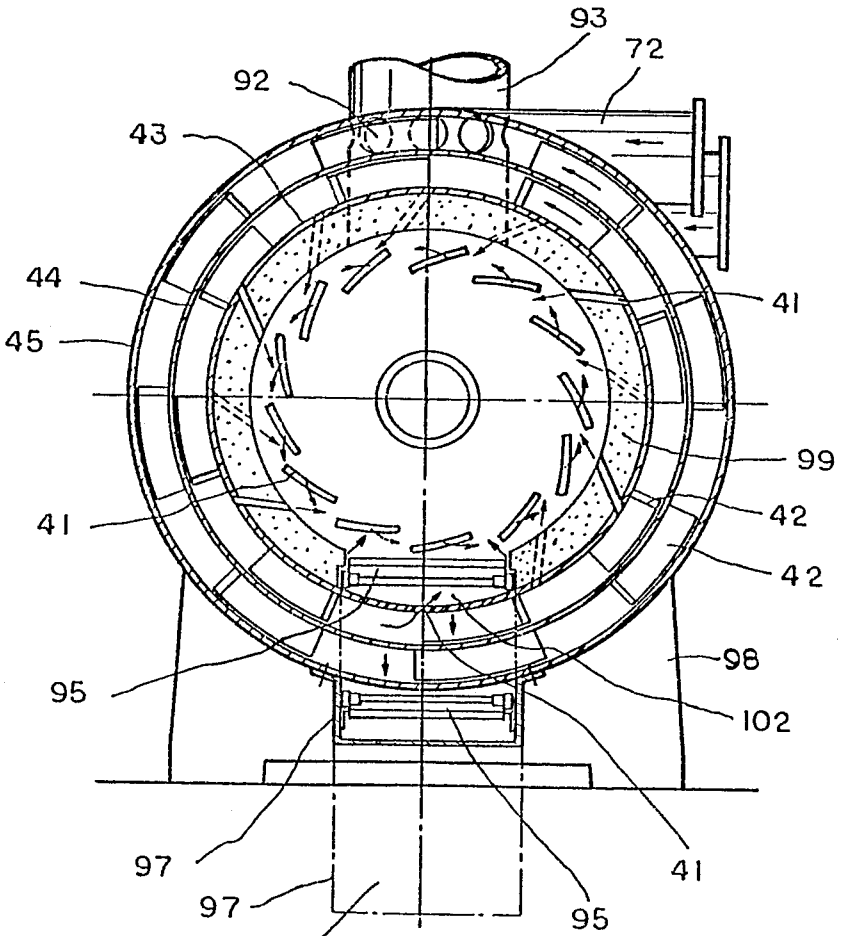
FIG. 10. is a cross-section view taken along the line A—A of FIG. 1.

As seen from FIGS. 9 and 10, the incinerator 4 of the present invention is utilized to operate in association with a burning furnace 2.

The incinerator 4 includes essentially an inner pipe 43, an intermediate pipe 44, an outer pipe 45, a waste product input duct 93 having a plurality of hot air bores 92, a plurality of tertiary air flow inlets 72, a plurality of radiating whirling or air directing sheets 42, an ash conveyor 95, and an ash conveyor chamber housing 97. An ash discharge outlet 46 is provuded on one end of the incinerator 4. A plurality of tangential air inlets 41 are provided on the inner pipe 43 so that air can flow into the inner space to help combustion. A transmitting axis 100 is employed to rotate transmitting gears 96 engageable with the ash conveyor 95. Refractory material 99 is coated on the inside wall of the inner pipe 43. Two partition plates 101 are provided between the two transmitting gears 96 so that air flows can be prevented from being hindered. Several bases 98 are employed to support the incinerator 4. The diameter of the transmitting gears 96 is larger than the distance between the walls of the iner pipe 43 and the outer pipe 45. The housing 97 is employed to prevent the hot air flow in the incinerator 4 from leaking outward and in the meanwhile, prevent the cool air flow outside of the incinerator 4 from coming into the incinerator 4. The air flows can come into the space 102 formed between the ash conveyor 95 and the wall portion of the inner pipe 43 below the ash conveyor 95, through the tangential air inlets 41 so as to promote combustion and lower the temperature of the ash conveyor 95. The ash, after being burned, is discharged out of the incinerator 4 via the ash discharge outlet 46 continuously.

What is claimed is:

1. A high speed burning furnace and incinerator, wherein the incinerator comprises a burner which includes a fuel tank, a mixer, and a controller for controlling the amount of the fuel and the air flow; a burner furnace; an incinerator means which includes mainly an outer pipe, an intermediate pipe, and an inner pipe which are all of transverse cylindrical shape, wherein a neck portion on the right side of the inner pipe is of a truncated conical shape and is connected to the burning furnace; a preheating chamber located on the outer pipe of the incinerator means said incinerator being characterized in that the incinerator is provided with an endless ash conveyor within said incinerator, said ash conveyor having two transmitting gears that engage with said ash conveyor to rotate said ash conveyor, said gears having as axis that is mounted within said incinerator and two partition plates inside said ash conveyor, said partition plates being located between said two transmitting gears.

2. The burning furnace and incinerator as in claim 1, wherein a plurality of tangential air inlets are formed on the inner pipe, a space is formed between the ash conveyor and the wall portion of the inner pipe below the ash conveyor, and wherein an air flow can come into said space through the tangential air inlets to promote combustion and lower the temperature of the ash conveyor

3. The burining furnace and incinerator as in claim 1, wherein a housing is provided to cover the ash conveyor area so that the hot air flow in the incinerator can be prevented from leaking outward and the cool air flow outside of the incinerator can be prevented from coming into the incinerator.

4. The burning furnace and incinerator as in claim 1, wherein the inner wall of the inner pipe is provided with a refractory material, and the inner pipe is provided with a plurality of tangential air inlet so that an air flow can come into the inner space of the incinerator and help combustion.

5. The burnhng furnace and incinerator as in claim 1 where several bases are provided for supporting the incinerator.

* * * * *